US009302744B2

(12) United States Patent
Pettersen

(10) Patent No.: US 9,302,744 B2
(45) Date of Patent: Apr. 5, 2016

(54) TRANSFER SYSTEM

(75) Inventor: Paal Pettersen, Staumsgrend (NO)

(73) Assignee: Framo Engineering AS, Bergen (NO)

( * ) Notice: Subject to any disclaimer, the term of this patent is extended or adjusted under 35 U.S.C. 154(b) by 0 days.

(21) Appl. No.: 13/885,385

(22) PCT Filed: Nov. 16, 2011

(86) PCT No.: PCT/EP2011/070238

§ 371 (c)(1),
(2), (4) Date: Jun. 26, 2013

(87) PCT Pub. No.: WO2012/066031

PCT Pub. Date: May 24, 2012

(65) Prior Publication Data

US 2013/0266381 A1 Oct. 10, 2013

(30) Foreign Application Priority Data

Nov. 16, 2010 (NO) ..... 20101609

(51) Int. Cl.

| | |
|---|---|
| ***B63B 27/24*** | (2006.01) |
| ***E21B 17/01*** | (2006.01) |
| ***B63B 22/00*** | (2006.01) |
| *B63B 27/34* | (2006.01) |

(52) U.S. Cl.

CPC ..... *B63B 27/24* (2013.01); *B63B 22/00* (2013.01); *E21B 17/012* (2013.01); *E21B 17/015* (2013.01); *B63B 27/34* (2013.01)

(58) Field of Classification Search

CPC ..... B63B 22/00; B63B 27/24; B63B 27/34; E21B 17/012; E21B 17/015

USPC ..... 405/158, 169, 171, 224, 224.2; 441/4, 441/5; 114/230.12; 166/350, 352

See application file for complete search history.

(56) References Cited

U.S. PATENT DOCUMENTS

| | | | | |
|---|---|---|---|---|
| 3,837,380 | A | 9/1974 | Davies | |
| 4,321,720 | A * | 3/1982 | Havre | 441/5 |
| 4,547,163 | A | 10/1985 | Langpaap et al. | |
| 4,650,431 | A * | 3/1987 | Kentosh | 441/5 |
| 5,316,509 | A * | 5/1994 | Boatman et al. | 441/3 |

(Continued)

FOREIGN PATENT DOCUMENTS

| | | |
|---|---|---|
| FR | 2381166 | 9/1978 |
| GB | 2012715 | 8/1979 |

(Continued)

*Primary Examiner* — Benjamin Fiorello
(74) *Attorney, Agent, or Firm* — Conley Rose, P.C.

(57) ABSTRACT

A transfer system is described including a subsea installation fixed relative to a seabed, and a transfer element for transfer of fluid, electrical signals, or electric current between the subsea installation and a floating arrangement. The transfer element is configured to connect to the subsea installation and includes a connector for connecting to the floating arrangement. The transfer system includes a buoyancy element anchored to the seabed, and has a through-going hole in the vertical direction. The transfer element extends through the hole and is movable in both directions through the hole. The transfer element includes a fender system that extends at least partially around the circumference of the transfer element. The fender system abuts the buoyancy element when the transfer element is suspended. When the transfer element is suspended, the transfer element forms an S-shape or J-shape between the subsea installation and the buoyancy element.

16 Claims, 9 Drawing Sheets

(56) References Cited

U.S. PATENT DOCUMENTS

| | | | | |
|---|---|---|---|---|
| 5,564,957 | A * | 10/1996 | Breivik et al. | 441/5 |
| 5,676,083 | A * | 10/1997 | Korsgaard | 114/230.1 |
| 5,944,448 | A | 8/1999 | Williams | |
| 6,688,348 | B2 | 2/2004 | Fontenot | |
| 6,811,355 | B2 * | 11/2004 | Poldervaart | 405/169 |
| 7,793,723 | B2 * | 9/2010 | Vedeld et al. | 166/355 |
| 2010/0285709 | A1 | 11/2010 | Lavagna | |

FOREIGN PATENT DOCUMENTS

| | | | |
|---|---|---|---|
| GB | 2098171 | | 11/1982 |
| GB | 2273087 | | 6/1994 |
| GB | 2316925 | A * | 3/1998 |
| WO | 2007/083238 | | 7/2007 |

* cited by examiner

TRANSFER SYSTEM

CROSS-REFERENCE TO RELATED APPLICATIONS

This application is a 35 U.S.C. §371 national stage application of PCT/EP2011/070238 filed Nov. 16, 2011, and entitled "Transfer System," which claims priority to Norwegian Application No. 20101609 filed Nov. 16, 2010, both of which are incorporated herein by reference in their entirety for all purposes.

FIELD OF THE INVENTION

The present invention relates to a transfer system for transferring at least one fluid and/or electrical signals and/or electric current between a subsea installation and a floating arrangement, together with methods for connecting and disconnecting the transfer system to and from the floating arrangement.

BACKGROUND OF THE INVENTION

A number of systems exist for transfer of a medium between two units offshore, where one unit is often a subsea installation, floating storage unit or a platform and the other unit a transport vessel.

Several of these systems have arrangements involving a transfer hose between the units, and when the hose is not in use, it is in a position where it is partially located on the seabed. Placing the hose in this position results in major wear and tear on parts of the hose, which means that the wear has to be monitored and parts of the hose have to be regularly replaced. These known loading systems are often also arranged so that the loading vessel can rotate freely and in an optimal manner relative to the weather when it is connected. In some systems this is accomplished by having a swivel system close to the connection point between the hose and the vessel. Alternatively, a submerged buoy may be provided which is housed in a receiving compartment in the vessel where the actual buoy or the end of the hose which is attached to the vessel comprises swivel devices, such as those described, for example, in U.S. Pat. No. 6,688,348. Another known system is to provide a swivel system at the anchoring point of the hose to the seabed. A system of this kind with swivels and their dynamic elements on the seabed leads to problems with regard to maintenance and repair. There are also systems which have permanently anchored towers with swivel devices arranged over the surface of the water. These are exposed to wind and weather and represent an obstacle to traffic on the surface of the water.

A transfer system is also known from GB 2273087, where a riser extends through an opening in a buoyancy element positioned below the surface. The transfer element is suspended in the buoyancy element in such a manner that the transfer element can form a J or an S-shape. We also refer to WO 2007/083238 which describes a loading system for loading from a subsea pipe system to a floating vessel.

SUMMARY OF THE INVENTION

An object of the present invention is to provide a transfer system which reduces the problems associated with previously known loading systems.

A further object is to provide a loading system which is easy to use and where the dynamic parts can be easily repaired and maintained.

Yet another object is to provide a system which represents the least possible obstacle to shipping traffic, which can be employed in a relatively large weather window and where no assistance vessel is required for connection to and disconnection from the loading vessel. It is also an object to provide a system which can be used for both shallow water (around 100 m) and relatively great depths, as well as in areas exposed to drift ice and icebergs.

These objects are achieved with a transfer system as defined in the independent claim 1 and methods for connecting and disconnecting the transfer system to and from a floating arrangement according to the independent claims 13 and 14. Further embodiments of the transfer system are indicated in the dependent claims 2-12 and 15.

The present invention relates to a transfer system of at least one fluid and/or electrical signal and/or electric current between a subsea installation and a floating arrangement. The subsea installation may have a need to transfer one or more media, such as a fluid, gas or liquid, signals, electricity etc., and may be a subsea storage station for a well, a well, a manifold for several wells or similar installations. The floating arrangement will normally be a loading ship, but may also be other types of floating vessels such as production ships, interim storage vessels or the like, or a platform.

The transfer system is specially suitable for use at depths of typically from 100 meters and deeper. It is also suitable for great depths from 1000 meters and deeper.

The transfer system comprises a subsea installation which is fixed relative to the seabed, for example securely mounted on the seabed, and at least one transfer element for transferring at least one fluid and/or electrical signals and/or electric current between the subsea installation and a floating arrangement. The transfer element is connected to the subsea installation on the bottom so that a point of the transfer element is held stable relative to the seabed. The point of the transfer element which is held stable may be close to the seabed or at a distance from the seabed.

The subsea installation may be any kind of arrangement, which when installed is in a fixed position on or relative to the seabed. The term seabed should also be understood to refer to the bed of a lake or fjord. In an embodiment the transfer element may comprise internal devices for transporting more than one type of fluid, for example by having coaxial internal annuli or spaces or ducts extending substantially in parallel in the longitudinal direction of the transfer element. A linkage may also be provided of a plurality of hoses or pipes.

The transfer element may, for example, be a flexible pipe, a flexible hose, a flexible riser or the like for transferring a fluid, such as for example hydrocarbons, between the subsea installation and the floating arrangement. The transfer element may also be an umbilical or a cable for transfer of electrical energy and/or signals of various kinds between the subsea installation and the floating arrangement.

The transfer element is connected to the subsea installation on the bottom such that a point of the transfer element is held stable relative to the seabed. This point of the transfer element which is held stable may be close to the seabed or at a distance from the seabed.

The transfer element also comprises connecting means for connecting to the floating arrangement at its free end. These connecting means preferably comprise a coupling device which is mounted near the transfer system's free end and comprises a swivel and a quick release coupling which comes into effect in the event of overloading. The quick release coupling is preferably also self-closing.

The coupling is arranged to be joined to a receiving device in the floating installation. Such a coupling may be a standard hose coupling, a so-called "Hose End Valve".

On account of the swivel, the coupling device will permit rotation about the transfer element's longitudinal axis when the transfer element is connected to the floating arrangement. This solution gives the floating arrangement, which is secured to the transfer element, a relatively flexible operating surface when the transfer element is connected.

Valves and other devices will also be provided in the system to ensure that no environmentally harmful substances and fluids are released into the environment.

The transfer system is further provided with a buoyancy system comprising a buoy with one or more buoyancy elements which are anchored to the seabed by means of a mooring system. This may be an entirely standard mooring system such as that normally used for buoys and other installations at sea and may consist of a fibre rope combined with chains or other anchors and/or piles on the bottom. The buoyancy system may have adjustable buoyancy or comprise buoyancy elements with fixed, non-adjustable buoyancy or a combination thereof.

The buoyancy system is normally submerged at a depth substantially below the wave zone, normally 30-70 meters below the surface of the water. At this depth the upper end of the transfer element will not obstruct shipping traffic and the transfer element will also be affected to the least possible extent by the action of the waves.

The buoyancy element is provided with at least one through-going hole in the vertical direction when the transfer system is installed. The at least one transfer element extends through the at least one hole in the buoyancy element and is movable in both directions through the at least one hole, i.e. it can be freely pulled up through the hole or lowered through the hole. The at least one buoyancy element keeps the transfer element in position and acts as a guide element for the transfer element when the transfer element is connected and disconnected.

In a preferred embodiment of the invention the at least one buoyancy element is generally doughnut-shaped, i.e. it may be toroidal or quasi-toroidal in shape. In this context a quasi-toroidal form will mean that the doughnut-shaped buoyancy element does not have a circular cross section as a regular torus has, but may have a cross section with, for example, an elliptical shape, a polygonal shape or a more irregular shape.

Alternatively, the at least one buoyancy element may be provided with two or more vertically through-going holes for lead-through and suspension of a corresponding number of transfer elements. For example, the at least one buoyancy element may be provided with two holes and have an approximately figure of eight shape, with a transfer element extending through each of the two holes. The at least one buoyancy element may also be of another shape if this is expedient.

The at least one transfer element further comprises a fender system which is attached to the transfer element and extends at least partially round the circumference of the transfer element, preferably round the whole circumference, and designed so as to abut against the at least one buoyancy element when the at least one transfer element is suspended and not in use. The fender system is preferably mounted at the free end of the at least one transfer element so that the entire transfer element is substantially located between the subsea installation and the buoyancy element when the transfer element is suspended in the buoyancy element.

When the transfer element is suspended in the at least one buoyancy element, the buoyancy element preferably forms an S-shape, or alternatively a J-shape, between the subsea installation and the buoyancy element, with the result that the transfer element is located above the seabed, thereby reducing the wear on the transfer element and the connecting device which are mounted at the free end of the transfer element.

In an embodiment of the invention the transfer system further comprises a swivel coupling, which is mounted near the mooring device on the seabed and permits rotation about the transfer element's longitudinal axis and a vertical axis.

The transfer system also comprises a retrieval arrangement, thereby enabling a vessel to pick up the free end of the transfer element and connect the free end to the receiving system on board the vessel. Such a retrieval arrangement may comprise a standard retrieval arrangement, with a vertical line to the surface, buoyancy buoys and a pick-up line on the surface with a marker buoy. This process has to be reversed when the vessel is to be released. The retrieval arrangement is moved to the surface of the sea with buoyancy buoys, floating buoys and a locating buoy (marker buoy) for retrieval of the floating arrangement.

According to the invention a vessel will arrive at the location of the loading system and first pick up the marker buoy. By means of a winch, for example, the vessel begins to haul in the pick-up line which is attached to the marker buoy. The free end of the flexible transfer element is then pulled towards the vessel and connected thereto.

When the transfer system is connected to the floating arrangement, the floating arrangement picks up a locating buoy with the use of suitable means, and hauls in the pick-up line, one end of which is attached to the locating buoy and the other end attached to the free end of the transfer element. The transfer element is thereby pulled through the hole in the at least one buoyancy element into the floating arrangement where the transfer element's free end is connected to the floating arrangement.

When the transfer system is disconnected from the floating arrangement, with the use of suitable means the floating arrangement takes a hold of the pick-up line, one end of which is attached to the locating buoy and the other end is attached to the free end of the transfer element. The transfer element is disconnected from the floating arrangement and lowered into the water so that the transfer element moves through the hole in the buoyancy element, forming an S-shape or a J-shape in the area between the subsea installation and the buoyancy element. The lowering of the transfer element continues until the fender system abuts against the buoyancy element. The pick-up line can then be dropped, leaving the transfer element suspended on the buoyancy element.

The present invention provides a transfer system which can be employed in a substantial weather window. The system has great flexibility with regard to movement of a connected vessel both in the horizontal and vertical plane, by means of the arrangement of the flexible transfer element through a free hole in the buoyancy buoy which is anchored to the bottom. This provides a system which has increased operational reliability. Furthermore, a retrieval system according to the invention offers a simplified connecting and disconnecting system. The fact that the flexible transfer element is arranged freely suspended in the water when the system is not in operation or connected to the vessel will lead to less wear on the transfer element and the valve connection at the free end. This is a serious problem in other corresponding systems which are located partially on the bottom. The transfer element will have an external sleeve which will protect the surface of the transfer system when it is pulled up through the hole in the at least one buoyancy element. In addition an extra sleeve will protect the transfer element during the actual loading operation. This sleeve can be replaced by an ROV when the transfer element is not connected to the floating arrangement.

The transfer system can be employed at varying depths. This may be arranged by adjusting the mooring system and the length of the vertical part of the transfer element from the subsea installation located on the bottom.

BRIEF DESCRIPTION OF THE DRAWINGS

A non-limiting embodiment of the invention will now be explained in greater detail with reference to the attached drawings, in which.

DETAILED DESCRIPTION OF THE INVENTION

Figure 1:
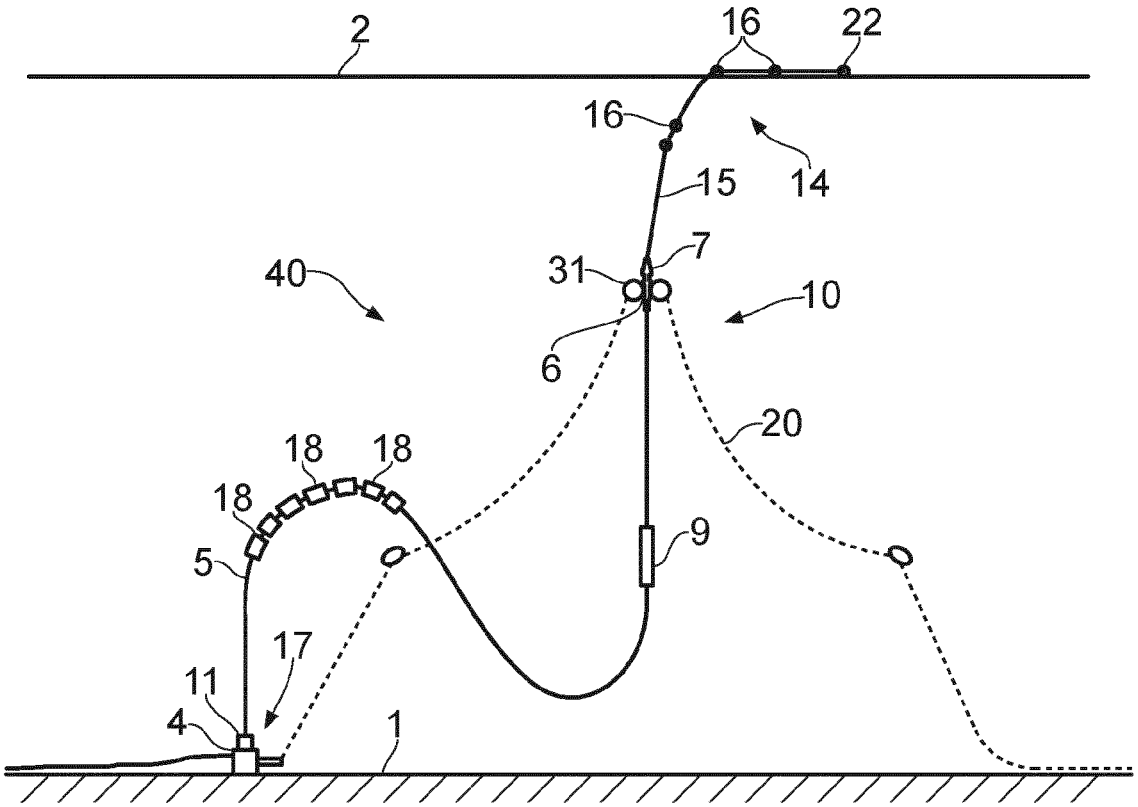
FIG. 1 illustrates the transfer system when it is not in use.
Figure 2:
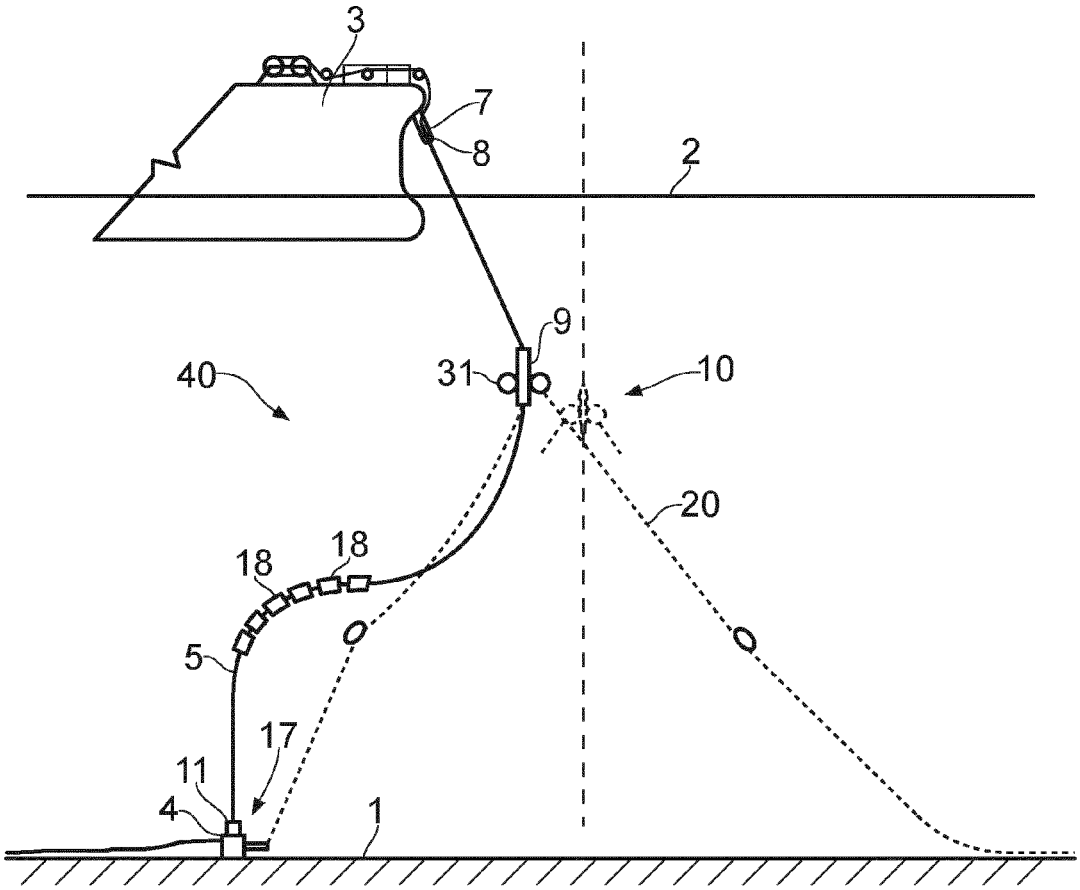
FIG. 2 illustrates the transfer system when it is connected to a floating arrangement.

FIGS. 1 and 2 illustrate the principle of the present transfer system when it is not in use and when it is in use.

In FIG. 1 the transfer system 40 is depicted in a suspended position (FIG. 1), i.e. where the transfer system is not connected to a floating arrangement 3 (see FIG. 2) for transferring one or more fluids, electric current or signals between a subsea installation 4 and the floating arrangement 3. In FIG. 2 the transfer system is connected to the floating arrangement 3.

The transfer system 40 comprises a transfer element 5 which is connected at a first end 17 to the subsea installation 4. This transfer element may, for example, be a fluid line for transport of hydrocarbons, an umbilical or another type of cable. The embodiment of the transfer system 40 which is illustrated in the figures is designed so that the transfer system forms an S-shape when the transfer system 40 is located in a suspended position as illustrated in FIG. 1. The transfer element is therefore provided with sufficient flexibility to permit the transfer element 5 to assume such a position. In order to achieve an S-shape in the transfer element as shown in the figures, the first end 17 of the transfer element 5 is advantageously arranged in such a manner that the transfer element 5 projects up from the subsea installation 4, preferably within an angle of ±30° relative to a vertical line. At or near the first end 17 of the transfer element 5 a swivel coupling 11 may also advantageously be mounted, permitting the transfer element to rotate about the transfer element's 5 longitudinal axis.

The transfer element 5 is furthermore provided with at least one, but preferably more buoyancy elements 18, with the result that the transfer element 5 assumes the desired S-shape when the transfer element is suspended.

The transfer system 40 further comprises a buoyancy system 10. The buoyancy system 10 comprises at least one buoyancy element 31 which is connected to a mooring system 20 for anchoring to the seabed 1. The mooring system 20 is preferably a common standard mooring system which will be known to a person skilled in the art and will therefore not be further described here. As already mentioned, the buoyancy system 10 will preferably be placed below the surface 2 at a depth which prevents the transfer system from being influenced by waves and currents in the upper layers of the water to a noticeable degree, and which furthermore does not interfere with traffic on the surface of the water.

The buoyancy element 31 in the embodiment illustrated in the figures is provided with a central hole 6 (see FIGS. 3-5) through which the transfer element 5 is passed. When the free end 7 of the transfer element has to be connected to or disconnected from the floating arrangement 3, the transfer element 5 moves through the hole 6 in the buoyancy element 31. Thus the buoyancy element acts as a guide element for the transfer element 5 during connection and disconnection. When the flexible transfer element 5 is passed through the opening 6 in the buoy, it will have the effect of cleaning any fouling from the flexible transfer element 5.

As indicated in FIGS. 1 and 2, the buoyancy system will be able to move slightly when the transfer element 5 is connected to the floating arrangement 3 depending on the vessel's location relative to the buoyancy element 31.

At the transfer element's free end 7, which is connected to a floating arrangement when the transfer system 40 is to be used, a retrieval system 14 is also attached. The retrieval system 14 comprises a pick-up line 15, one end of which is attached to the transfer element's 5 free end 7 and to a locating buoy 22 at the other end. The pick-up line may also be provided with one or more buoyancy elements 16 if so desired. The locating buoy 22 floats on the surface of the water 2, thereby making it easy for the floating arrangement to find the transfer system 40. The locating buoy 22 may be a standard reflector buoy or a so-called AIS buoy (AIS: active instrument system) which transmits signals which a radar from the floating arrangement 3, for example a vessel or a platform, will be able to intercept at a distance of several kilometers.

Figure 3:
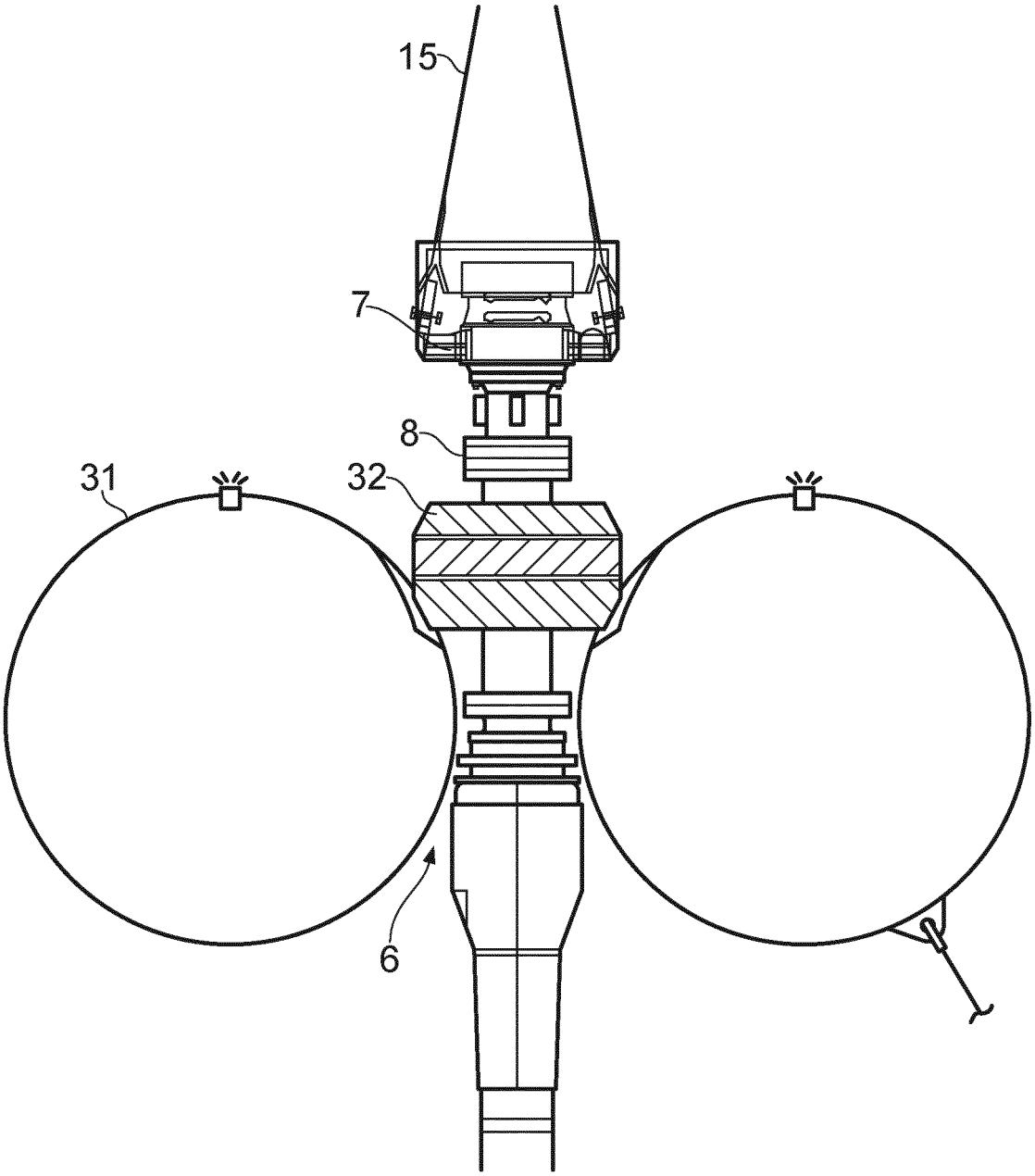
FIG. 3 illustrates a first embodiment of the buoyancy element with the transfer element suspended in the buoyancy element.
Figure 4:
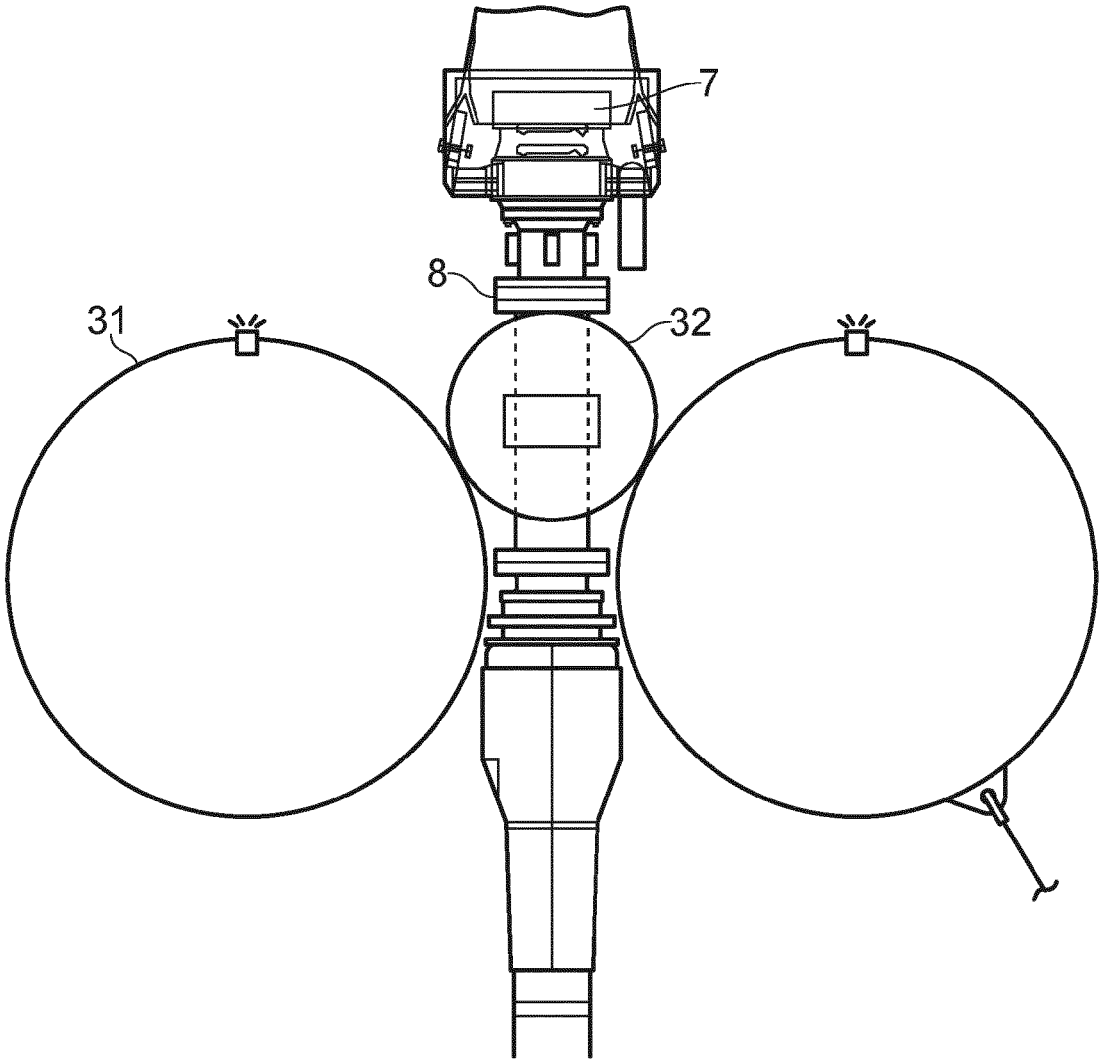
FIG. 4 illustrates an embodiment of the invention illustrated in FIG. 3 with an alternative embodiment of the buoyancy element's fender system.
Figure 5:
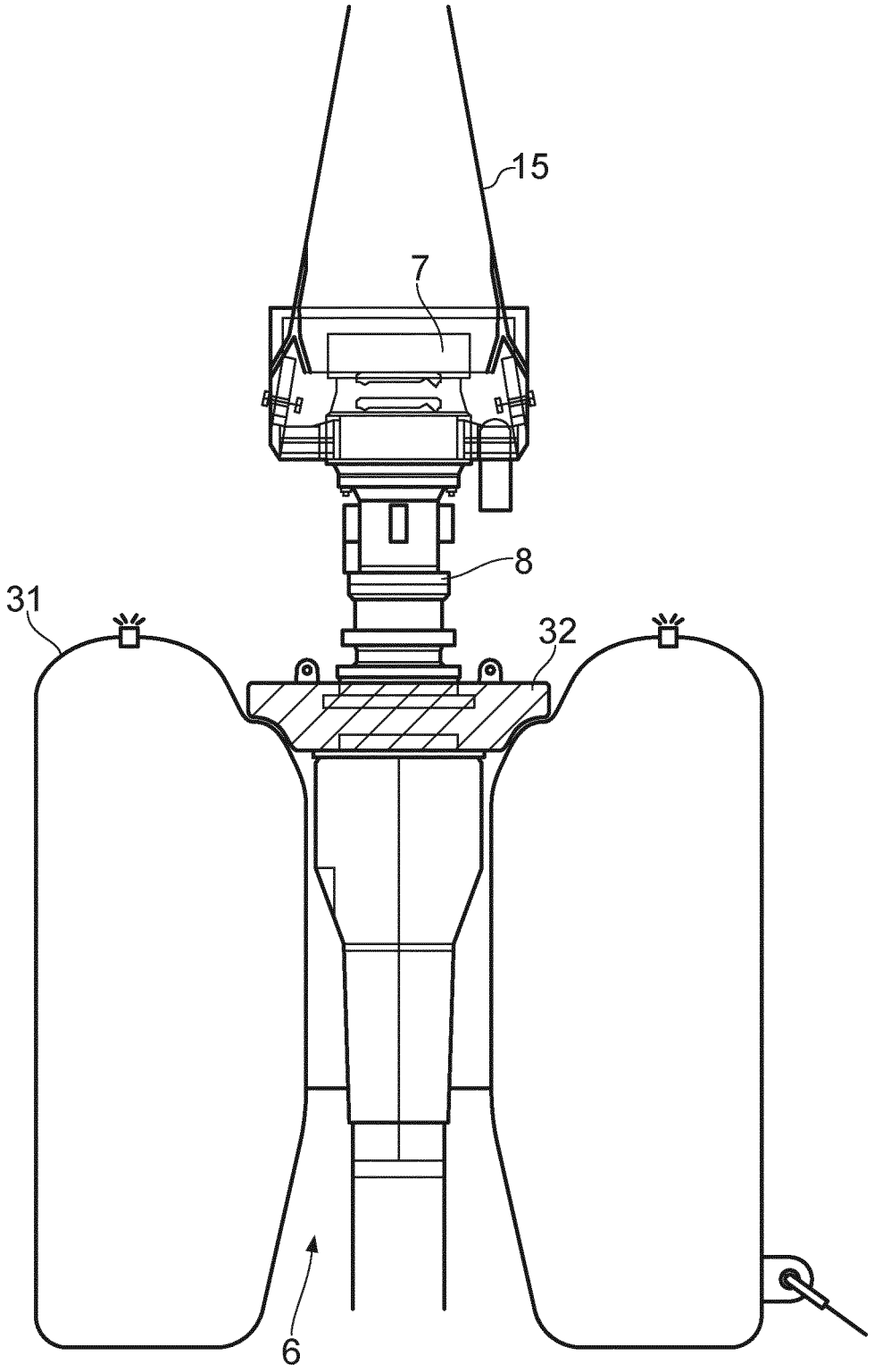
FIG. 5 illustrates a second embodiment of the buoyancy element with the transfer element suspended in the buoyancy element.

At or near the free end 7 of the transfer element a fender system 32 is further provided (see FIGS. 3-5). This fender system preferably extends round the whole circumference of the transfer element 5. The fender system 32 is so arranged that when the transfer element is suspended after disconnection from the floating arrangement 3, the fender system will abut against the top of the buoyancy element 31 and the transfer element will be suspended from the buoyancy element. Thus the buoyancy element 31 also acts as a supporting element holding the transfer element 5 when the transfer system 40 is not in use.

When the transfer element 5 is suspended in the buoyancy element 31, the transfer element 5 will be suspended straight down from the buoyancy element and some distance downwards. The transfer element 5 is preferably provided with a wear sleeve 9 which abuts against the inside of the buoyancy element 31 when the transfer element 5 is connected to the floating arrangement 3. The wear sleeve 9 preferably extends at least over a distance so that it is the wear sleeve 9 which is in contact with the buoyancy element 31 when the transfer element 5 is connected to the floating arrangement 3 and the floating arrangement is moving up and down in the water because of waves.

In FIG. 3 a first embodiment of the buoyancy element 31 is illustrated with the transfer element 5 suspended in the buoyancy element 31. The buoyancy element 31 which is illustrated in the figure is toroidal in form, i.e. doughnut-shaped with a through-going hole 6 for lead-through of the transfer element 5.

As already mentioned, the transfer element 5 is provided with a fender system 32 which abuts against the buoyancy element 31 when the transfer element 5 is suspended. For this purpose the buoyancy element 31 may be provided with a cut-out in a shape which matches the shape of the fender system 32. The fender system 32 is preferably at least partly made of a rubber material to cushion the contact between the fender system 32 and the buoyancy element 31. If required, the buoyancy element 31 may also be provided with a rubber material on the inside where the fender system 32 may come into contact with the buoyancy element 31. In this manner the transfer system 40 will be freely suspended in the sea with a retrieval arrangement 14 which is passed up to the surface where it is connected to a pick-up line 15 and a set of buoys 16, including a marker buoy 22.

Alternatively, the fender system 32 may be in the form of a ball which abuts naturally against the hole 6 in the buoyancy element 31, as illustrated in FIG. 4. This avoids the need for a special cut-out in the buoyancy element 31.

The transfer element 5 also preferably comprises a swivel coupling 8 which is preferably mounted between the fender system 32 and the transfer element's 5 free end 7. The swivel coupling 8 will permit a rotation of the transfer element 5 relative to the free end 7 which is connected to a floating arrangement 3. The swivel coupling 8 may also advantageously comprise a self-closing, quick-release coupling which is arranged for disconnection of the transfer element 5 in the event of overloading.

FIG. 5 illustrates a second embodiment of the buoyancy element 31. This embodiment has a different geometrical shape, but otherwise there are no practical differences from the embodiment of the invention illustrated in FIG. 3. In both the embodiments the buoyancy element 31 may alternatively be made of steel or a synthetic material such as for example "Syntactic foam".

Figure 6:
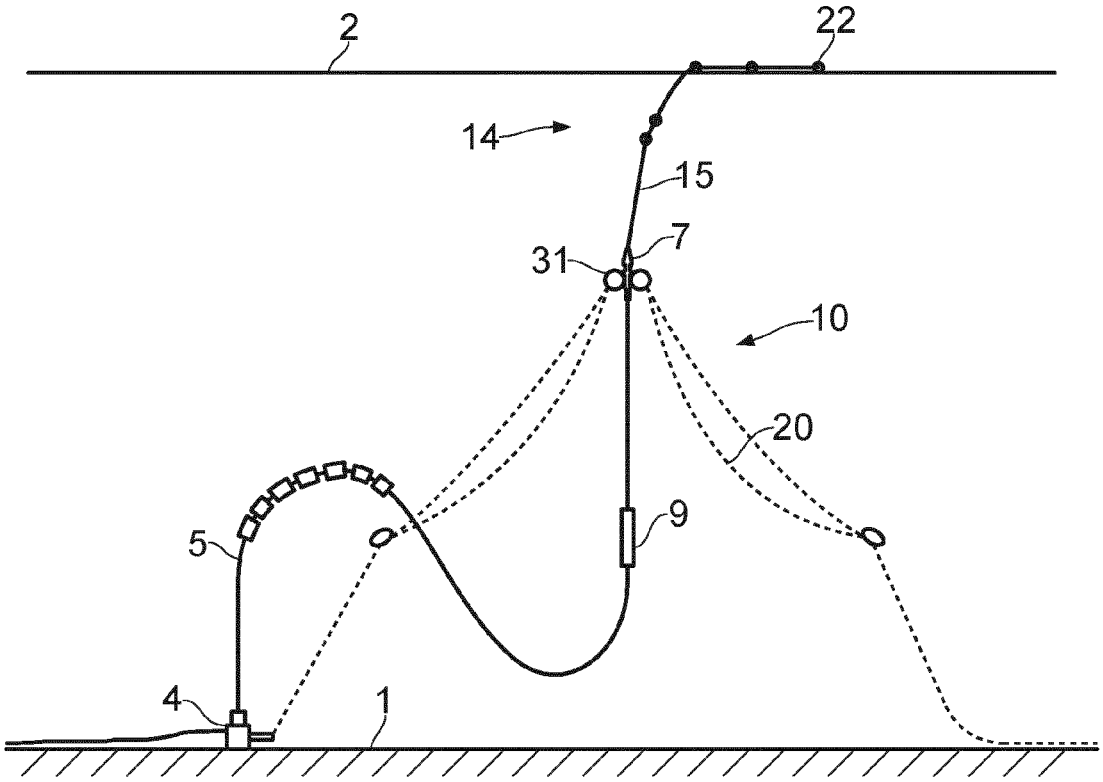
FIGS. 6-9 illustrate the connection of the transfer element to the floating arrangement.
Figure 7:
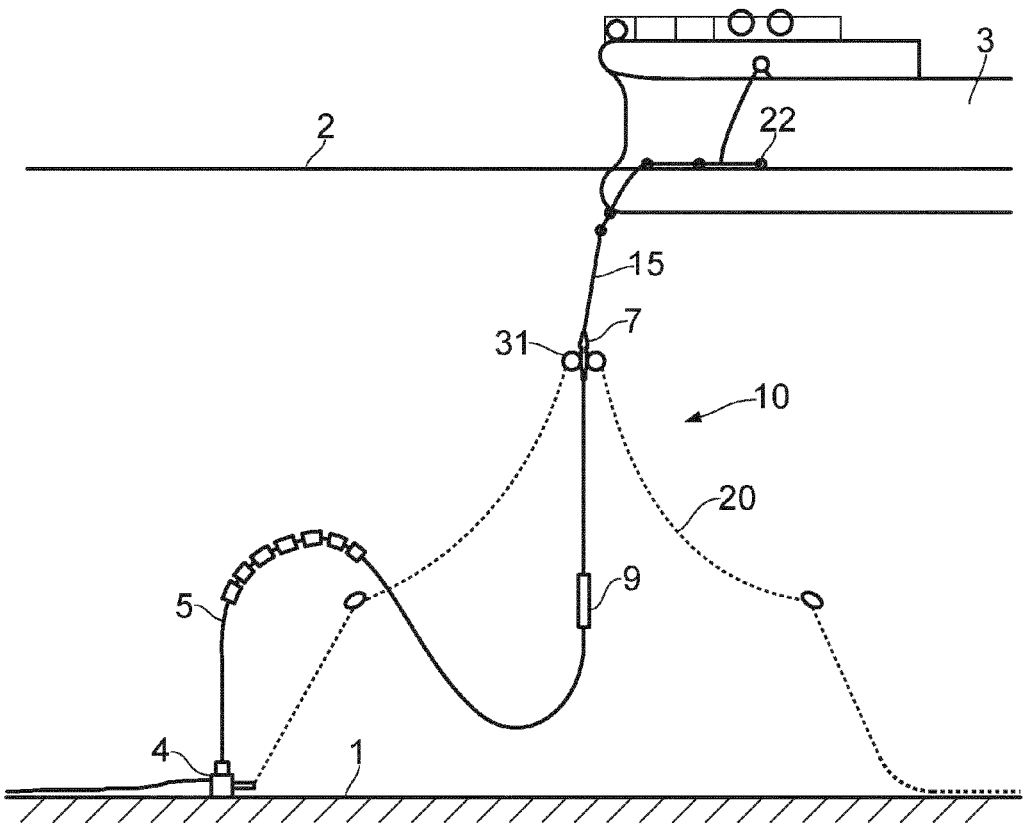
Figure 8:
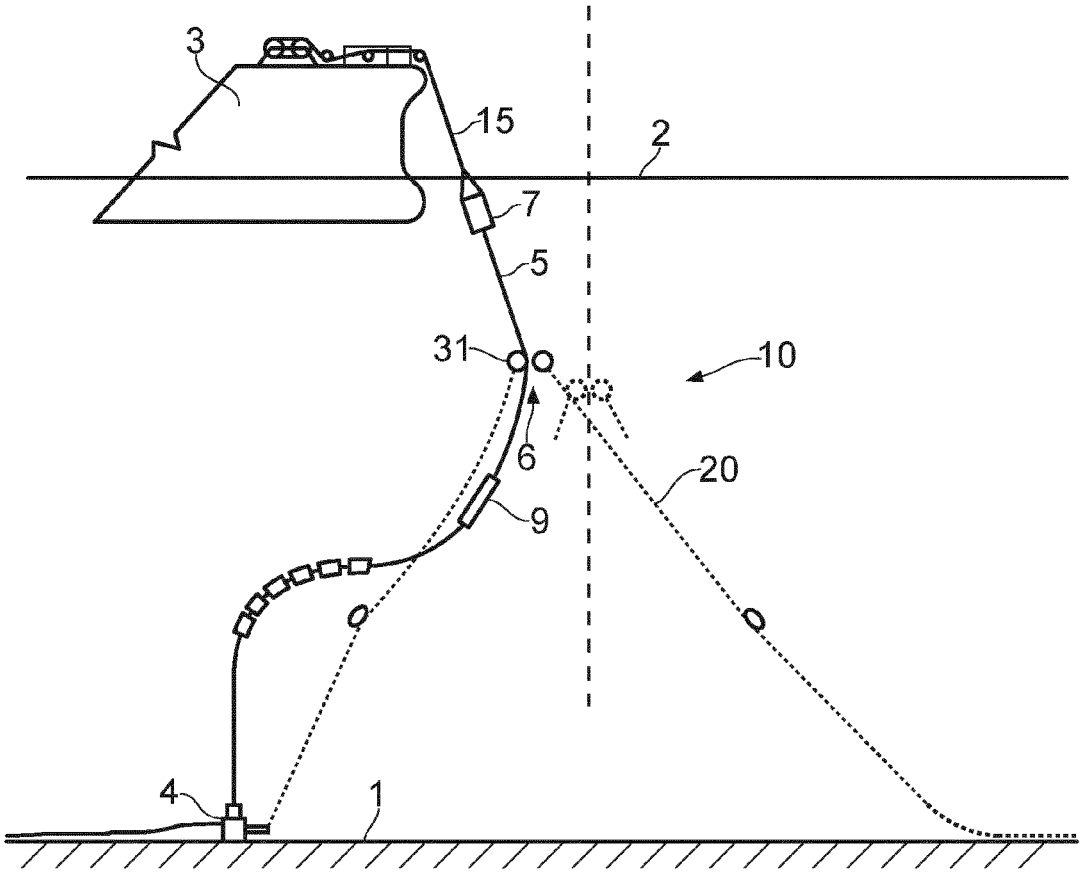
Figure 9:
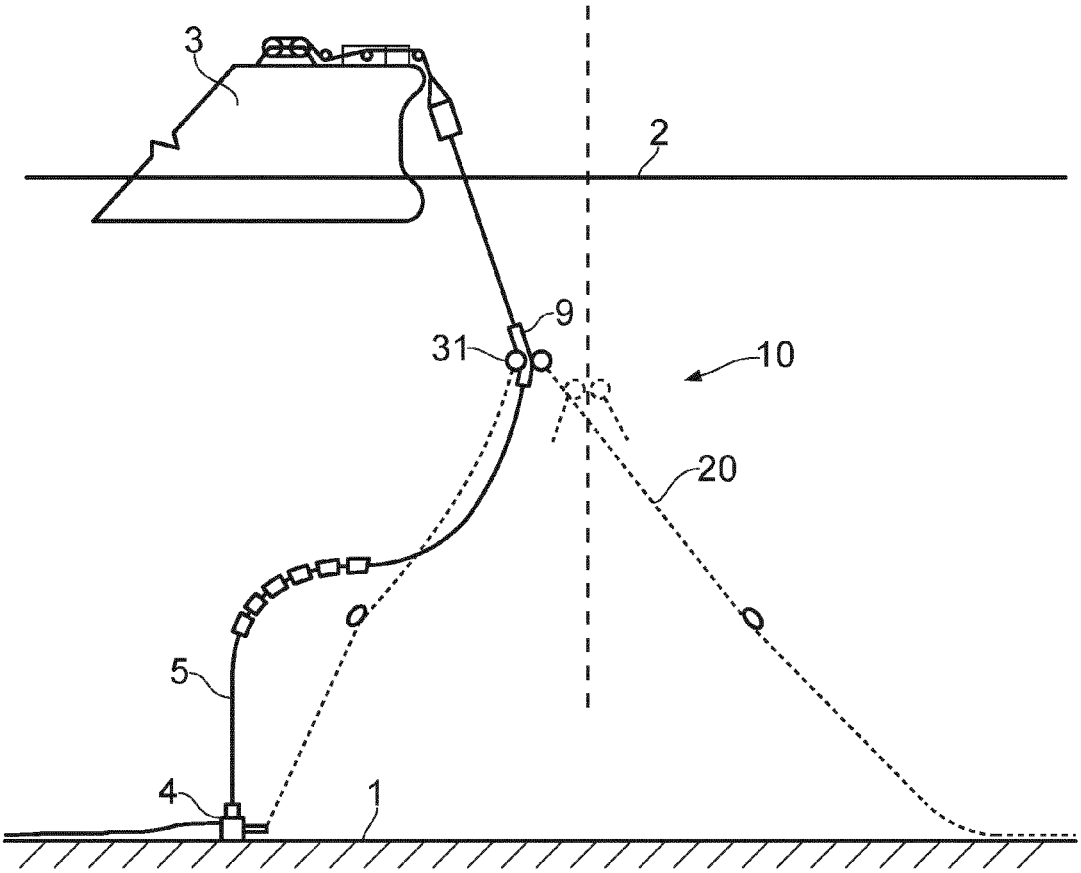

In FIGS. 6-9 four sequences are shown for connecting the transfer element 31 to a floating arrangement 3. In FIG. 6 the transfer system 40 is depicted ready installed and with the transfer element 5 suspended in the buoyancy element 31. FIG. 7 illustrates the floating arrangement 3, for example a vessel, arriving at the place where the transfer system 40 is located and picking up the locating buoy 22. FIG. 8 illustrates the vessel 3 beginning to haul in the pick-up line 15 which is attached to the locating buoy 22 and the free end 7 of the flexible transfer element 5 is then pulled towards the vessel 3. Finally FIG. 9 shows the free end 7 of the transfer element 5 being connected to the vessel 3.

The invention has now been explained with reference to the special embodiments as illustrated in the attached figures. A person skilled in the art will appreciate that changes and modifications may be made to these embodiments which are within the scope of the invention as defined in the attached patent claims. A skilled person will also understand that the transfer system could be equipped with necessary shut-off valves, corrosion protection, wear coating on the flexible transfer element etc. which are not described in detail here.

The invention claimed is:

1. A transfer system, comprising:

a subsea installation fixed relative to a seabed;

a buoyancy element anchored to the seabed, wherein the buoyancy element comprises at least one through-going hole in the vertical direction;

at least one transfer element for transfer of at least one of fluid, electrical signals, or electric current between the subsea installation and a floating arrangement, wherein the transfer element is configured to connect to the subsea installation at a first end, extend through the hole in the buoyancy element, and move in both directions through the hole, the transfer element further comprising:

a coupling device to connect to the floating arrangement at a free end of the transfer element, wherein the coupling device comprises a swivel and a quick-release coupling that comes into effect in the event of overloading, and wherein the coupling device permits rotation about a longitudinal axis of the transfer element when the transfer element is coupled to the floating arrangement; and a fender system spaced apart from the coupling device that extends at least partially around a circumference of the transfer element, the fender system configured to abut the buoyancy element when the transfer element is suspended in the buoyancy element; and a locating buoy coupled to the free end of the transfer element by a pick-up line;

wherein the transfer element forms an S-shape or J-shape between the subsea installation and the buoyancy element when it is suspended in the buoyancy element such that the transfer element is located above the seabed and contact between the transfer element and the seabed is thereby avoided.

2. The transfer system according to claim 1, wherein the quick-release coupling is self-closing.

3. The transfer system according to claim 1, wherein the transfer system further comprises a swivel coupling which is mounted close to the subsea installation on the seabed, which swivel coupling permits rotation about a longitudinal axis of the transfer element.

4. The transfer system according to claim 1, wherein the fender system is arranged at the free end of the transfer element.

5. The transfer system according to claim 1, wherein the buoyancy element is toroidal or quasi-toroidal.

6. The transfer system according to claim 1, wherein the buoyancy element is provided with two or more vertically through-going holes for lead-through and suspension of a corresponding number of transfer elements.

7. The transfer system according to claim 1, wherein the transfer element is a fluid line for transfer of hydrocarbons.

8. The transfer system according to claim 1, wherein the transfer element is an umbilical.

9. The transfer system according to claim 1, wherein the transfer element is a cable for transfer of electrical signals or electric current.

10. The transfer system according to claim 1, wherein the floating arrangement is a vessel.

11. The transfer system according to claim 1, wherein the floating arrangement is a platform.

12. A method for connecting the transfer system according to claim 1 to the floating arrangement, wherein the floating arrangement picks up the locating buoy and hauls in the pick-up line, one end of which is attached to the locating buoy and the other end of which is attached to the free end of the transfer element, whereby the transfer element is pulled through the hole in the buoyancy element into the floating arrangement where the transfer element's free end is connected to the floating arrangement.

13. The transfer system according to claim 1, wherein the pick-up line is configured to be engaged by the floating arrangement and wherein the transfer element is pulled through the hole in the buoyancy element in response to the pick-up line being engaged by the floating arrangement.

14. The transfer system according to claim 1, wherein the pick-up line further comprises one or more buoyancy elements disposed between the locating buoy and the free end of the transfer element.

15. A method for disconnecting the transfer system according to claim 1 from the floating arrangement, wherein the floating arrangement gets hold of the pick-up line, one end of which is attached to the locating buoy and the other end of which is attached to the free end of the transfer element, whereby the transfer element is disconnected from the floating arrangement and lowered into the water so that the transfer element moves through the hole in the buoyancy element, forming an S-shape or a J-shape between the subsea installation and the buoyancy element, and whereby the lowering of the transfer element continues until the fender system abuts against the buoyancy element, whereupon the pick-up line is released, with the result that the transfer element is suspended on the buoyancy element.

16. The method according to claim 15, wherein when the pick-up line is released from the floating arrangement, the pick-up line and the locating buoy are arranged in their positions for a new pick-up.

* * * * *